US012134163B2

(12) United States Patent
Yamanaka

(10) Patent No.: US 12,134,163 B2
(45) Date of Patent: Nov. 5, 2024

(54) FINE ADJUSTMENT DEVICE

(71) Applicant: DISCO CORPORATION, Tokyo (JP)

(72) Inventor: Satoshi Yamanaka, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 533 days.

(21) Appl. No.: 17/448,427

(22) Filed: Sep. 22, 2021

(65) Prior Publication Data

US 2022/0105603 A1 Apr. 7, 2022

(30) Foreign Application Priority Data

Oct. 7, 2020 (JP) ..... 2020-169686

(51) Int. Cl.
*B24B 41/06* (2012.01)
*B24B 47/12* (2006.01)
*B24B 49/10* (2006.01)

(52) U.S. Cl.
CPC ..... *B24B 41/06* (2013.01); *B24B 47/12* (2013.01); *B24B 49/10* (2013.01)

(58) Field of Classification Search
CPC ... B23Q 1/34; B23Q 1/00; B23Q 1/36; B23Q 11/0032; B23Q 15/22; B23Q 16/008; B23Q 2210/002; B23Q 2716/08; B23Q 3/18; B23Q 5/28; H02N 2/0095; H02N 2/043; H02N 2/0025; H02N 2/026; H02N 2/001; H02N 2/005; H02N 2/04; H02N 2/103; B24B 47/22; B24B 27/0076; B24B 37/048; B24B 41/04; B24B 41/067; B24B 47/12; B24B 47/20; B24B 49/16; G02B 7/023; G02B 7/198; G02B 23/02; G02B 26/0833; G02B 26/0858; G02B 7/003; G02B 7/004; G02B 7/182; G02B 7/1822; G02B 7/1824; G02B 7/1825; G02B 7/183; G02B 7/192;

(Continued)

(56) References Cited

U.S. PATENT DOCUMENTS 7,218,032 B2 * 5/2007 Kim ..... H02N 2/043 310/323.17
2017/0153186 A1 * 6/2017 Jeanne ..... H01L 22/12
2020/0246939 A1 * 8/2020 Kashiwagi ..... B24B 41/005

FOREIGN PATENT DOCUMENTS

JP H07122524 A * 5/1995
JP 2002001653 A 1/2002
JP 2008264913 A 11/2008

OTHER PUBLICATIONS

Fuubaa et al., JP H07122524 A, May 12, 1995, translation (Year: 1995).*

* cited by examiner

*Primary Examiner* — Joel D Crandall
(74) *Attorney, Agent, or Firm* — Greer Burns & Crain Ltd.

(57) ABSTRACT

A fine adjustment device that is interposed between a table base rotatably supporting a chuck table for holding a workpiece on a holding surface and a base supporting the table base and that adjusts a distance between the table base and the base. The fine adjustment device includes: a support member that has an upper section and an intermediate section and a lower section, with the upper section fixed to the table base and with the intermediate section fixed to the base; an accommodating chamber formed in the support member; a piezoelectric actuator that is accommodated in the accommodating chamber and is capable of contracting and extending in a perpendicular direction; and a contraction-extension structure to have the accommodating chamber contracted and extended in the perpendicular direction.

5 Claims, 7 Drawing Sheets

(58) Field of Classification Search
CPC ..... H01L 21/68; H01L 21/67259; H01L 21/67288; H01L 21/68764; H01L 22/12; B23B 2260/004; B23B 2260/068; B23B 2260/124; B23B 2260/146; B23B 2270/06; B23B 25/065; B23B 29/12; B25J 9/0072; B29C 65/542; B29C 65/56; B29C 66/30321; B29C 66/30325; B29L 2012/00; B81C 99/002; F16M 11/04; F16M 11/043; F16M 11/045; F16M 11/046; F16M 11/18; F16M 2200/028; G01B 11/26; G01N 21/8851; G01N 21/9501; G03F 7/70275; G03F 7/70716; G03F 7/70758; G03F 7/70825; Y10T 29/49004; Y10T 74/20006; Y10T 74/20564; G11B 5/1871; G11B 5/3103; G11B 5/3116; G11B 5/3163; G11B 5/3169; G11B 5/3173; G11B 5/3903; G11B 5/3967
USPC ..... 310/328, 317, 323.16; 451/5, 11, 285, 451/398, 405; 385/16; 74/470, 517
See application file for complete search history.

FINE ADJUSTMENT DEVICE

BACKGROUND OF THE INVENTION

Field of the Invention

The present invention relates to a fine adjustment device for adjusting a height or an inclination of a chuck table and to a processing apparatus including the fine adjustment device.

Description of the Related Art

As disclosed in Japanese Patent Laid-Open No. 2002-001653 and Japanese Patent Laid-Open No. 2008-264913, a grinding apparatus that grinds a workpiece held on a holding surface of a chuck table by use of a grindstone includes fine adjustment devices for adjusting an inclination of the chuck table such that the holding surface becomes parallel to a lower surface of the grindstone.

Such fine adjustment devices rotate screw support columns supporting the chuck table by motors, and, by screwing-in of the screw support columns, the chuck table is pressed upward or pressed downward to modify the inclination of the chuck table.

SUMMARY OF THE INVENTION

Conventionally, when the chuck table is lowered, rotation of the screw support columns in the direction for lowering the chuck table may cause the chuck table to be lowered excessively, and, by the excessive amount, the screw support columns are rotated in the direction for raising the chuck table to raise the chuck table (backlash adjustment). Therefore, there has been a problem that it takes time to adjust the inclination of the chuck table.

Accordingly, an object of the present invention is to provide a fine adjustment device for a chuck table that can shorten the adjustment time and a processing apparatus including the fine adjustment device.

In accordance with an aspect of the present invention, there is provided a fine adjustment device that is interposed between a table base rotatably supporting a chuck table for holding a workpiece on a holding surface and a base supporting the table base and that adjusts a distance between the table base and the base. The fine adjustment device includes a support member that has an upper section and an intermediate section and a lower section, with the upper section fixed to the table base and with the intermediate section fixed to the base; an accommodating chamber formed in the support member; a piezoelectric actuator that is accommodated in the accommodating chamber and is capable of contracting and extending in a perpendicular direction; and a contraction-extension structure in which first slits for cutting the intermediate section partially from a first side and second slits for cutting the intermediate section partially from a side opposite to the first side are alternately formed in plurality, whereby the accommodating chamber is capable of being contracted and extended in the perpendicular direction. By controlling a voltage supplied to the piezoelectric actuator, the piezoelectric actuator is contracted and extended, and the contraction-extension structure is contracted and extended to enable the distance between the base and the table base to be changed.

Preferably, a plurality of the fine adjustment devices are disposed between the table base and the base at intervals in a circumferential direction, and, by finely adjusting the plurality of fine adjustment devices, an inclination of the holding surface of the chuck table mounted on the table base is adjusted. Preferably, the abovementioned fine adjustment device further includes a compression spring mechanism that compresses the contraction-extension structure.

In accordance with another aspect of the present invention, there is provided a processing apparatus including a chuck table that holds a workpiece on a holding surface; a processing unit that has a processing tool disposed in a rotatable manner and that processes the workpiece held on the holding surface of the chuck table; a control unit; and a fine adjustment device that is interposed between a table base rotatably supporting the chuck table and a base on which the table base is disposed and that adjusts a distance between the table base and the base. The fine adjustment device includes a support member that has an upper section and an intermediate section and a lower section, with the upper section fixed to the table base and with the intermediate section fixed to the base; an accommodating chamber formed in the support member; a piezoelectric actuator that is accommodated in the accommodating chamber and is capable of contracting and extending in a perpendicular direction; and a contraction-extension structure in which first slits for cutting the intermediate section partially from a first side and second slits for cutting the intermediate section partially from a side opposite to the first side are alternately formed in plurality, whereby the accommodating chamber is capable of being contracted and extended in the perpendicular direction. The control unit controls a voltage supplied to the piezoelectric actuator of the fine adjustment device, to thereby contract and extend the piezoelectric actuator, whereby an inclination of the holding surface of the chuck table mounted on the table base in a rotatable manner is capable of being adjusted.

Preferably, the processing unit includes a rotatable grinding wheel on which a plurality of grindstones are arranged in an annular pattern. The processing apparatus further includes a motor that rotates a rotary shaft of the chuck table around the holding surface, and an encoder that detects a rotational angle of the rotary shaft. The control unit controls a voltage supplied to the piezoelectric actuator according to the rotational angle detected by the encoder, to thereby change the inclination of the holding surface of the chuck table according to the rotational angle and to grind the workpiece by the grindstones.

Since the fine adjustment device of the present invention has high responsiveness due to an elastic structure composed of a plurality of slits formed in the intermediate section of the support member, it is possible to modify the inclination of the holding surface of the chuck table and to modify the height position of the holding surface in a short time as compared to the existing adjustment shafts. In addition, since the fine adjustment device uses the piezoelectric actuator, it is possible to extremely minutely adjust the distance between the table base and the base. Further, since the fine adjustment device has the compression spring mechanism, the whole length thereof can be shortened, and a reduction in size of the processing apparatus can be realized.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
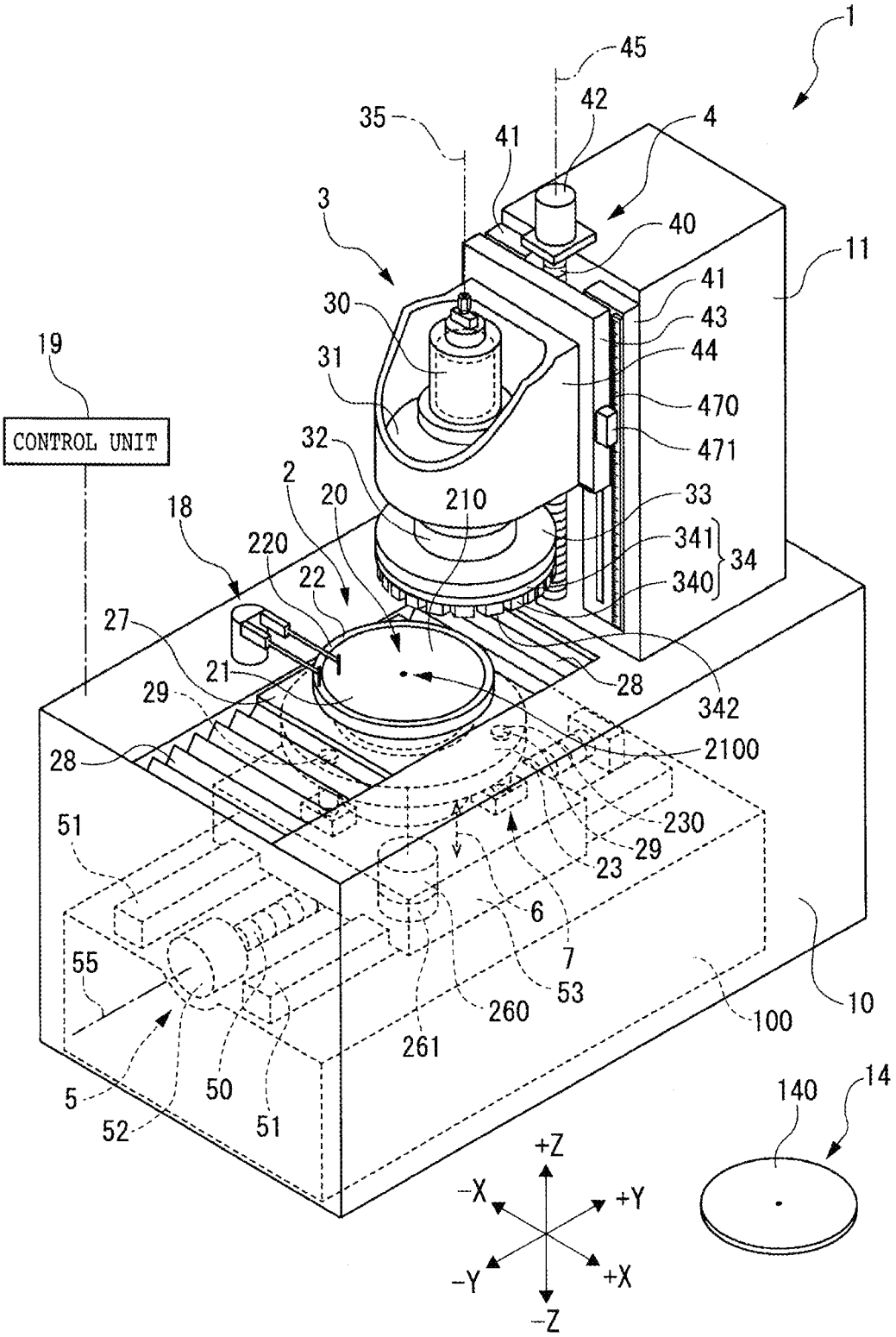
FIG. 1 is a perspective view depicting the whole of a processing apparatus.

A processing apparatus 1 depicted in FIG. 1 is a grinding apparatus that grinds a disk-shaped workpiece 14 by use of a processing unit 3. The configuration of the processing apparatus 1 will be described below. As depicted in FIG. 1, the processing apparatus 1 includes a base 10 extended in a Y-axis direction, and a column 11 erected on a +Y direction side of the base 10.

On a side surface on a −Y direction side of the column 11, a processing feeding mechanism 4 that supports the processing unit 3 in the manner of being liftable upward and downward is disposed. The processing unit 3 is, for example, a grinding unit that includes a spindle 32 having a rotational axis 35 in a Z-axis direction, a housing 31 supporting the spindle 32 in a rotatable manner, a spindle motor 30 rotationally driving the spindle 32 around an axis in the Z-axis direction, a mount 33 connected to a lower end of the spindle 32, and a grinding wheel 34 detachably mounted to a lower surface of the mount 33.

The grinding wheel 34 includes a wheel base 341, and a plurality of substantially rectangular parallelepiped grindstones 340 arranged in an annular pattern on a lower surface of the wheel base 341. The grindstones 340 are processing tools that process the workpiece 14. Lower surfaces 342 of the grindstones 340 are grinding surfaces making contact with the workpiece 14.

With the spindle 32 rotated by use of the spindle motor 30, the mount 33 connected to the spindle 32 and the grinding wheel 34 mounted to the lower surface of the mount 33 are rotated as one body.

The processing feeding mechanism 4 includes a ball screw 40 having a rotational axis 45 in the Z-axis direction, a pair of guide rails 42 disposed in parallel to the ball screw 40, a Z-axis motor 42 that rotates the ball screw 40 around the rotational axis 45, a lifting plate 43 having a nut inside in screw engagement with the ball screw 40 and having side portions in sliding contact with the guide rails 41, and a holder 44 connected to the lifting plate 43 and supporting the processing unit 3.

When the ball screw 40 is driven by the Z-axis motor 42 and the ball screw 40 is rotated around the rotational axis 45, the lifting plate 43 is moved in the manner of being lifted upward and downward in the Z-axis direction while guided by the guide rails 41 attendant on this, and the processing unit 3 held by the holder 44 is moved in the Z-axis direction.

A scale 470 is disposed on a side surface on the −Y direction side of the guide rail 41, and a reading section 471 is disposed on a side surface on a +X direction side of the lifting plate 43. The reading section 471 has, for example, an optical recognition mechanism or the like for reading the graduation value formed on the scale 470, and can recognize the graduation of the scale 470 and can recognize the height position of the processing unit 3.

A holding unit 2 is disposed on the base 10. The holding unit 2 includes a chuck table 20 that holds the workpiece 14. The chuck table 20 includes a disk-shaped suction section 21 and a frame body 22 that supports the suction section 21. An upper surface of the suction section 21 is a holding surface 210 on which to hold the workpiece 14, and an upper surface 220 of the frame body 22 is formed flush with the holding surface 210.

In addition, the holding unit 2 includes a motor 260 that rotates the chuck table 20 around a center 2100 of the holding surface 210, and an encoder 261 that detects a rotational angle of the chuck table 20. While detecting the rotational angle of the chuck table 20 by use of the encoder 261, the chuck table 20 can be rotated by use of the motor 260.

At a position adjacent to the chuck table 20, a thickness measuring unit 18 for measuring a thickness of the workpiece 14 is disposed. The thickness measuring unit 18 has, for example, contact-type height gauges or the like, and the height gauges are brought into contact with an upper surface 140 of the workpiece 14 and the upper surface 220 of the frame body 22 to measure the difference between the heights of the upper surfaces, whereby the thickness of the workpiece 14 can be measured.

In addition, in the periphery of the chuck table 20, a cover 27 is disposed. The cover 27 is connected to a bellows 28 in such a manner as to be contractable and extendable. When the chuck table 20 is horizontally moved in the Y-axis direction, the cover 27 is moved in the Y-axis direction as one body with the chuck table 20, whereby the bellows 28 is contracted or extended.

In the inside of the base 10, an internal base 100 is disposed. A horizontal moving mechanism 5 for moving the chuck table 20 in a horizontal direction is disposed on the internal base 100. The horizontal moving mechanism 5 includes a ball screw 50 having a rotational axis 55 in the Y-axis direction, a Y-axis motor 52 for rotating the ball screw 50 around the rotational axis 55, a pair of guide rails 51 disposed in parallel to the ball screw 50, and a base 53 having a nut at a bottom portion in screw engagement of the ball screw 50 and moved in the Y-axis direction along the guide rails 51. With the ball screw 50 rotated by use of the Y-axis motor 52, the base 53 is moved horizontally in the Y-axis direction while guided by the guide rails 51.

Figure 2:
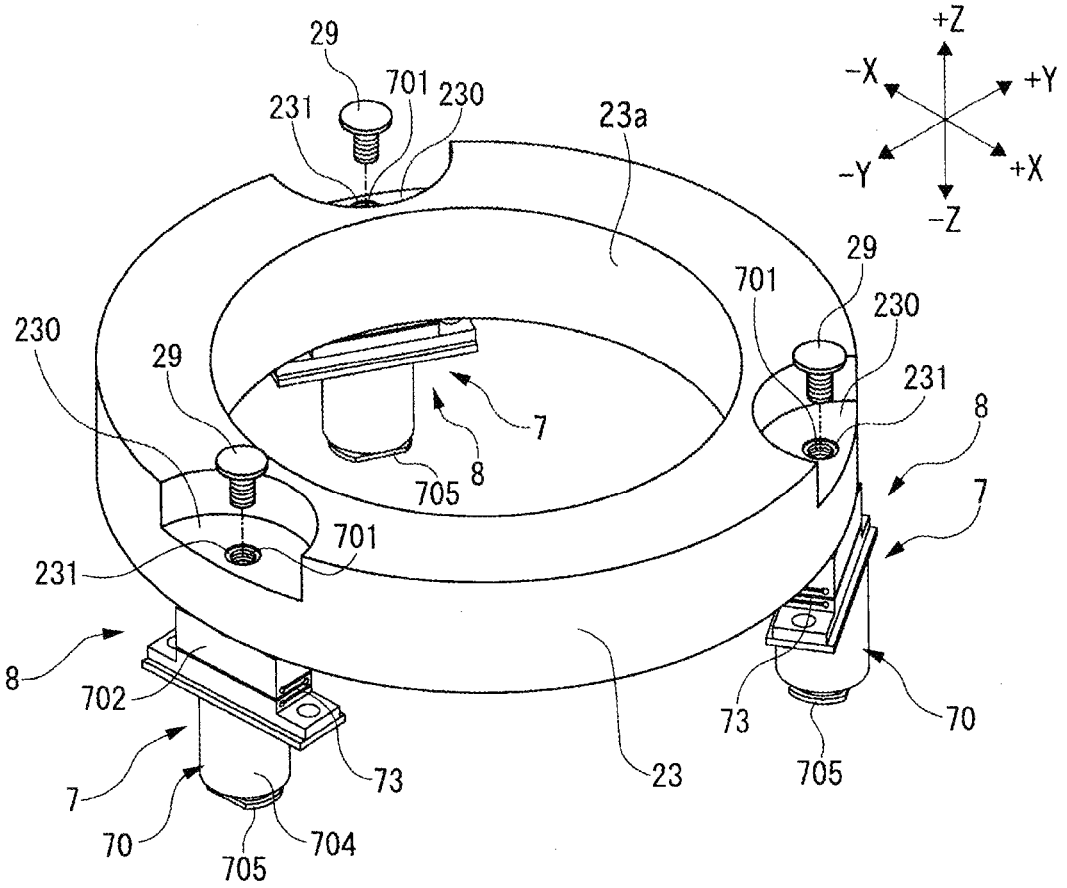
FIG. 2 is a perspective vide depicting a table base and a fine adjustment device.

The chuck table 20 is rotatably supported on a table base 23. The table base 23 is formed in an annular shape as depicted in FIG. 2, a support shaft (not illustrated) of the chuck table 20 is inserted in an inner circumferential hole 23*a* of the table base 23, and, between the support shaft and an inner circumferential surface of the table base 23, the chuck table 20 is rotatably mounted on the table base 23 through a bearing. For example, three recesses 230 are formed at regular-interval positions on the same circle circumference of the table base 23, and the recesses 230 are formed with through-holes 231 penetrating the table base 23 in the Z-axis direction.

Figure 3:
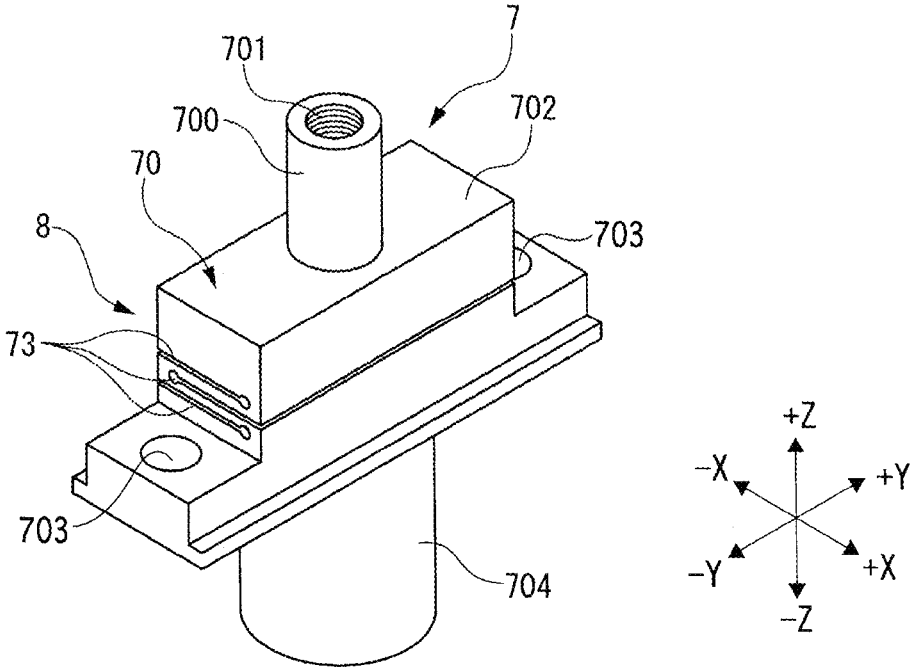
FIG. 3 is a perspective view of the fine adjustment device.

The chuck table 20 is supported by, for example, three fine adjustment devices 7. Each fine adjustment device 7 includes a support member 70 extending in the Z-axis direction as depicted in FIG. 3. The support member 70 includes a cylindrical upper section 700. The upper section 700 is formed to be loosely fittable in the through-hole 231 of the table base 23 depicted in FIG. 2. In FIG. 2, the upper sections 700 (not illustrated in FIG. 2) of the support members 70 are loosely fitted in the through-holes 231 of the table base 23, whereby the fine adjustment devices 7 and the table base 23 are united together.

The upper sections 700 are formed with screw holes 701 for screw engagement with set screws 29. For example, as depicted in FIG. 2, in a state in which the upper sections 700 are loosely fitted in the through-holes 231 of the table base 23 so that the fine adjustment devices 7 and the table base 23 are united together, the set screws 29 are screw engaged with the screw holes 701, whereby the fine adjustment devices 7 are fixed to the table base 23.

As depicted in FIG. 3, the support member 70 includes a substantially rectangular parallelepiped intermediate section 702 connected to a lower end of the upper section 700, and a cylindrical lower section 704 connected to the lower portion of the intermediate section 702. The lower section 704 is formed to be larger in diameter than the upper section 700. The lower sections 704 are inserted in holes 56 formed in the base 53 depicted in FIG. 1, and the fine adjustment devices 7 connect the table base 23 and the base 53 in an adjustable manner.

As depicted in FIG. 3, the intermediate section 702 is formed with a plurality of slits 73 that do not cut the support member 70 completely. Each slit 73 is formed in an XY plane direction orthogonal to the Z-axis direction, and the slits 73 formed by cutting into the intermediate section 702 from a −X direction side toward the +X direction side and the slits 73 formed by cutting into the intermediate section 702 from the +X direction side toward the −X direction side are alternately arranged at intervals to form layers. As depicted in FIG. 3, a pair of attaching holes 703 are formed on both sides of the intermediate section 702 of the support member 70.

Figure 4:
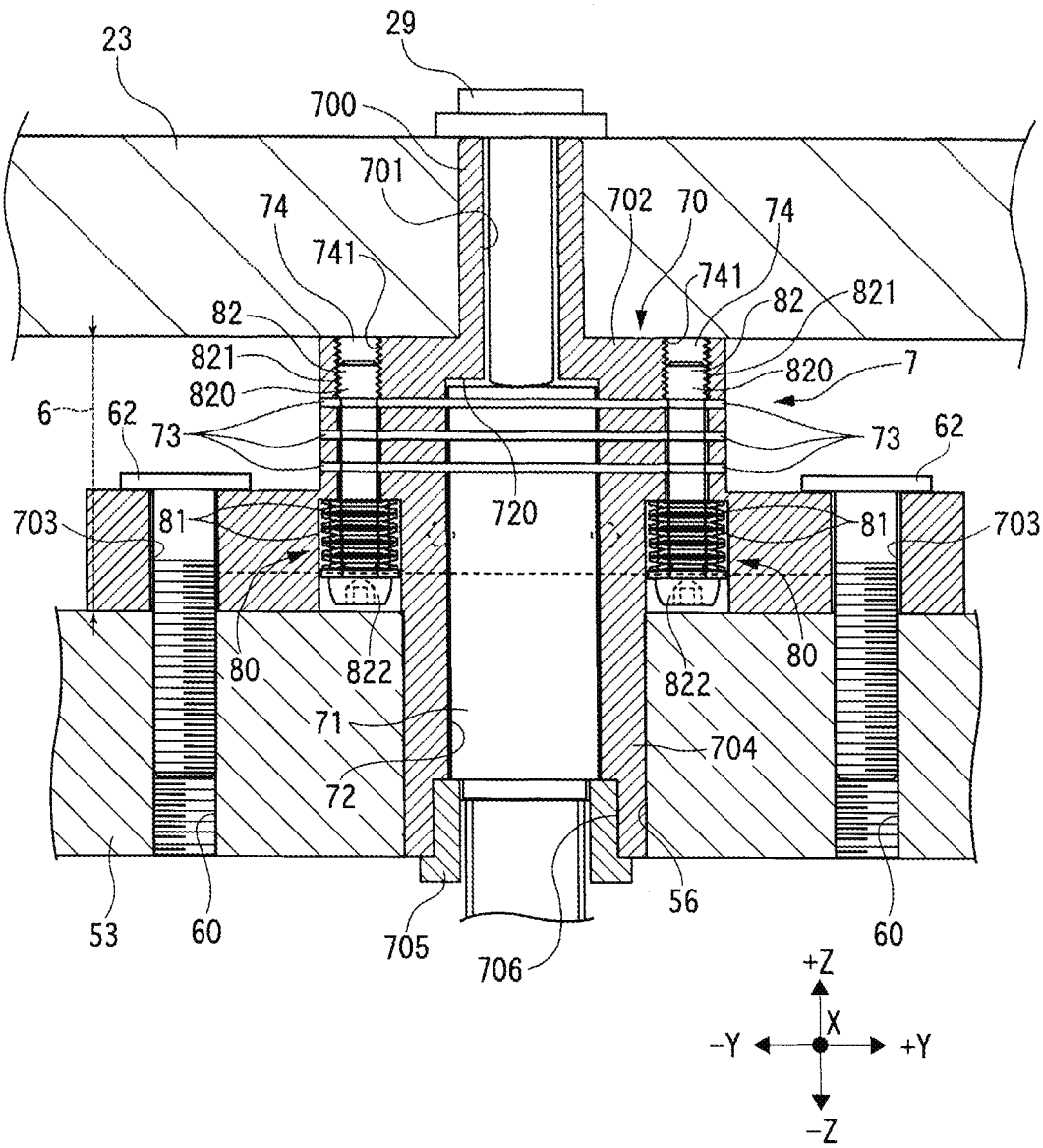
FIG. 4 is a sectional view of the fine adjustment device.

As illustrated in FIG. 4, the fine adjustment device 7 includes an accommodating chamber 72 extending in the Z-axis direction from the inside of the intermediate section 702 of the support member 70 to the inside of the lower section 704, a female screw 706 is formed at a lower portion of the accommodating chamber 72, and an annular screw 705 is screw engaged with the female screw 706. In the accommodating chamber 72 is accommodated a piezoelectric actuator 71 contractable and extendable in the Z-axis direction. The piezoelectric actuator 71 is connected to a power source (not illustrated), and, by supplying a voltage from the power source to the piezoelectric actuator 71, the piezoelectric actuator 71 can be contracted or extended in the Z-axis direction. The piezoelectric actuator 71 is compressed by the set screw 29 and the annular screw 705.

As depicted in FIG. 4, the support member 70 of the fine adjustment device 7 is fixed to the base 53 by inserting screws 62 in the attaching holes 703 and screw engaging the screws 62 in screw holes 60 formed in the base 53.

The fine adjustment device 7 includes a contraction-extension structure section 8 that includes the plurality of slits 73 formed in the support member 70 and a compression spring mechanism 80.

Figure 5:
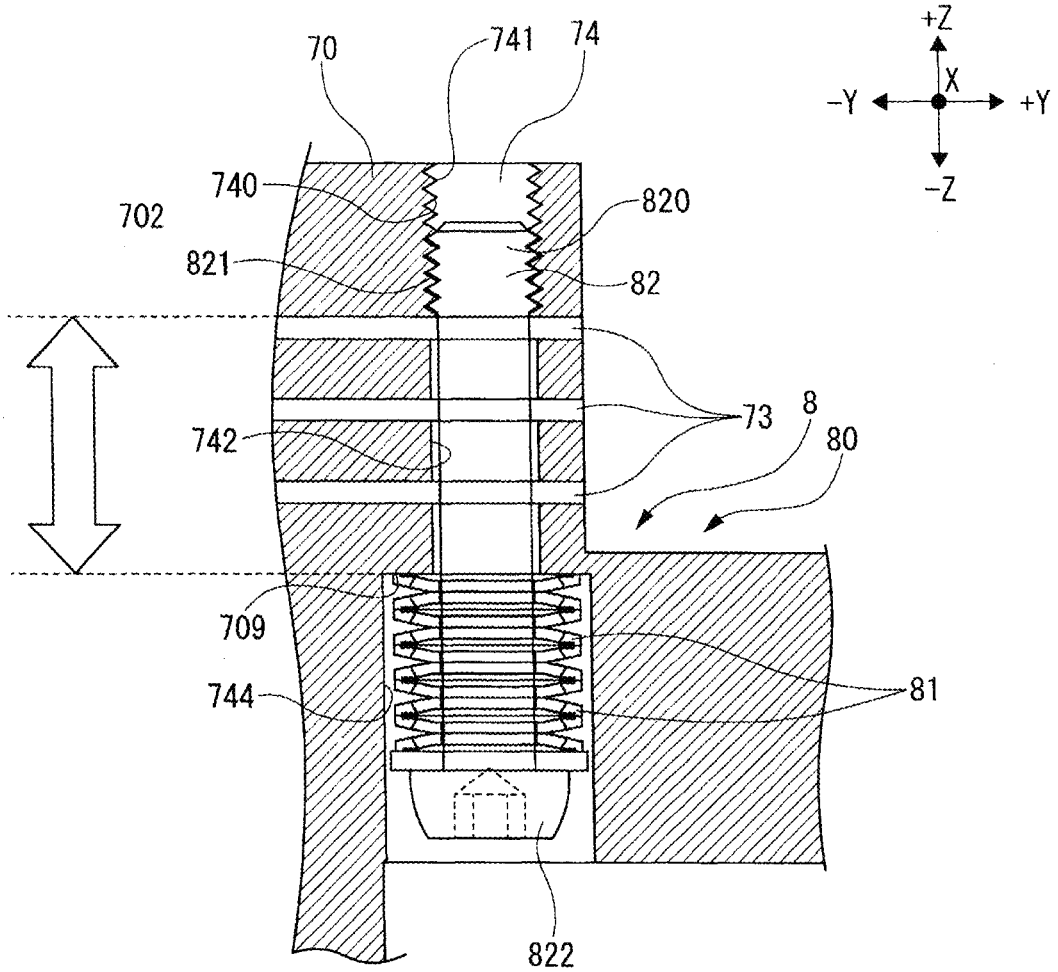
FIG. 5 is a sectional view depicting, partially in an enlarged form, particularly a contraction-extension structure section, of an inside of the fine adjustment device.

The compression spring mechanism 80 includes two through-holes 74 formed on the +Y direction side and the −Y direction side of the accommodating chamber 72 in the inside of the support member 70. FIG. 5 depicts a partial enlarged diagram in which the through-hole 74 formed on the +Y direction side of the accommodating chamber 72 is enlarged. The through-hole 74 is formed to penetrate the support member 70 in the Z-axis direction, and has an upper section 740 and a middle section 742 and a lower section 744. The upper section 740 and the middle section 742 are substantially the same in diameter, while the lower section 744 is formed to be larger in diameter than the upper section 740 and the middle section 742. The upper section 740 is formed with a female screw 741.

In addition, the compression spring mechanism 80 includes bolts 82 for engagement with the through-holes 74. The bolt 82 includes a shaft section 820 extending in the Z-axis direction, and a flange section 822 formed at a lower end of the shaft section 820. The shaft section 820 is formed in such a size as to be able to go into the upper section 740 and the middle section 742 of the through-hole 74, while the flange section 822 is formed in such a size as to be able to go into the lower section 744 of the through-hole 74.

A male screw 821 corresponding to the female screw 741 is formed at a tip of the shaft section 820. In the compression spring mechanism 80, the male screw 821 of the shaft section 820 is screw engaged with the female screw 741 of the through-hole 74, whereby the shaft section 820 is fastened to the upper section 740 of the through-hole 74.

A coned disk spring 81 contractable and extendable in the Z-axis direction is accommodated in the lower section 744 of the through-hole 74. The coned disk spring 81 is supported by the flange section 822 in a state of being penetrated by the shaft section 820.

In the fine adjustment device 7, when a voltage is supplied to the piezoelectric actuator 71 depicted in FIG. 4, the piezoelectric actuator 71 extends in the Z-axis direction, and an upper end 720 of an inner wall of the accommodating chamber 72 is pushed up in the +Z direction by the piezoelectric actuator 71, whereby the accommodating chamber 72 is extended, and the upper section 700 and an upper portion of the intermediate section 702 of the support member 70 are pushed upward in the +Z direction.

When the upper section 700 and an upper portion of the intermediate section 702 of the support member 70 are pushed upward in the +Z direction by the piezoelectric actuator 71, the shaft section 820 fastened to the upper section 740 of the through-hole 74 depicted in FIG. 5 is pulled upward in the +Z direction. As a result, a lower portion of the intermediate section 702 of the support member 70 is extended in the Z-axis direction according to an elastic structure of the slits 73, the flange section 822 of the bolt 82 is raised in the +Z direction, and the coned disk spring 81 is compressed between the flange section 822 and a lower end 709 of the intermediate section 702 of the support member 70.

By such an operation, the intermediate section 702 of the support member 70 extends in the Z-axis direction while the upper section 700 of the support member 70 depicted in FIG. 4 is raised in the +Z direction, whereby a distance 6 between the table base 23 and the base 53 can be extended.

In addition, the supply of the voltage to the piezoelectric actuator 71 is stopped, whereby the piezoelectric actuator 71 is contracted in the Z-axis direction and returns to its original length, and the accommodating chamber 72 returns to its original length, resulting in that the height positions of the upper section 700 and the intermediate section 702 of the support member 70 return to the original height positions.

By supplying the voltage to the piezoelectric actuator 71 to extend the piezoelectric actuator 71 and stopping the supply of the voltage to the piezoelectric actuator 71 to contract the piezoelectric actuator 71, the distance 6 between the table base 23 and the base 53 can be modified.

For example, by use of one fine adjustment device 7 of the three fine adjustment devices 7 depicted in FIG. 2, the distance 6 between the table base 23 at one site where the fine adjustment device 7 is disposed and the base 53 is modified, whereby the inclination of the holding surface 210 of the chuck table 20 can be modified. When, by use of the two fine adjustment devices 7 of the three fine adjustment devices 7, the distances 6 between the table base 23 at two sites where the two fine adjustment devices 7 are disposed and the base 53 are modified, also, the inclination of the holding surface 210 can be modified.

In addition, when, for example, by use of the three fine adjustment devices 7, the distances 6 between the table base 23 at three sites where the fine adjustment devices 7 are disposed and the base 53 are modified by the same amount, the height of the holding surface 210 of the chuck table 20 can be modified.

The processing apparatus 1 includes a control unit 19 that controls various mechanisms of the processing apparatus 1 as depicted in FIG. 1. The control unit 19 particularly has a function to control the magnitudes of the voltages supplied to the piezoelectric actuators 71 of the fine adjustment devices 7 to modify the inclination of the holding surface 210 to an appropriate inclination or to modify the height of the holding surface 210 to an appropriate height.

In grinding the workpiece 14 by use of the processing apparatus 1, first, the workpiece 14 depicted in FIG. 1 is mounted on the holding surface 210 of the chuck table 20. Then, the suction source (not illustrated) connected to the chuck table 20 is operated, and the suction force generated is transmitted to the holding surface 210. As a result, the workpiece 14 is held under suction on the holding surface 210.

Next, in a state in which the workpiece 14 is held under suction on the holding surface 210, the chuck table 20 is moved in the +Y direction by use of the horizontal moving mechanism 5, and the workpiece 14 is positioned under the processing unit 3. In this instance, the horizontal positional relation of the grindstones 340 and the workpiece 14 is adjusted such that the lower surfaces 342 of the grindstones 340 pass the center of the workpiece 14.

In addition, the chuck table 20 is preliminarily rotated around the center 2100 by use of the motor 260 to rotate the workpiece 14 held on the holding surface 210, and the grindstones 340 are preliminarily rotated around the rotational axis 35 by use of the spindle motor 30.

In a state in which the workpiece 14 held by the holding surface 210 is rotated and the grindstones 340 are rotated around the rotational axis 35, the processing unit 3 is lowered in the −Z direction by use of the processing feeding mechanism 4. As a result, the lower surfaces 342 of the grindstones 340 are brought into contact with the upper surface 140 of the workpiece 14.

In a state in which the lower surfaces 342 of the grindstones 340 are in contact with the upper surface 140 of the workpiece 14, the grindstones 340 are further lowered in the −Z direction, whereby the workpiece 14 is ground. During grinding of the workpiece 14, the thickness of the workpiece 14 is measured by use of the thickness measuring unit 18.

Figure 6:
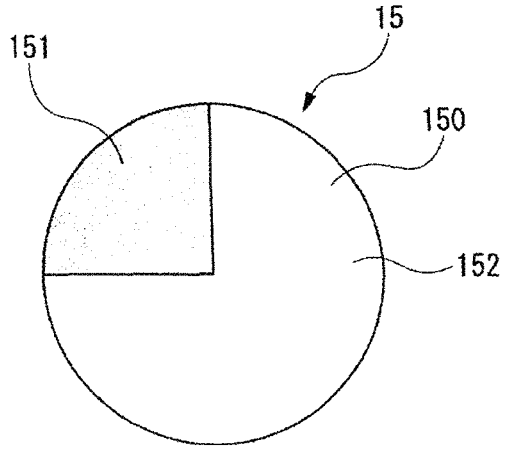
FIG. 6 is a top plan view depicting an example of a workpiece.

When grinding is conducted by use of the processing apparatus 1, a workpiece 15 having a partially different thickness as depicted in FIG. 6 may be formed. Such a difference in thickness is, for example, equal to or less than 1 μm. The workpiece 15 depicted in FIG. 6 is composed of a small fan-shaped part 151 and a large fan-shaped part 152 that have different thicknesses. The thickness of the small fan-shaped part 151 is greater than the thickness of the large fan-shaped part 152, and an upper surface 150 of the workpiece 15 is not formed at a uniform height.

To grind such a workpiece 15 to correct to a uniform thickness, first, while measuring the thickness of the workpiece 15 by use of the thickness measuring unit 18 depicted in FIG. 1, the chuck table 20 is rotated by use of the motor 260, and the rotational angle of the chuck table 20 is detected by use of the encoder 261. As a result, the thickness of the workpiece 15 is measured on the basis of the rotational angle of the chuck table 20.

Figure 7B:
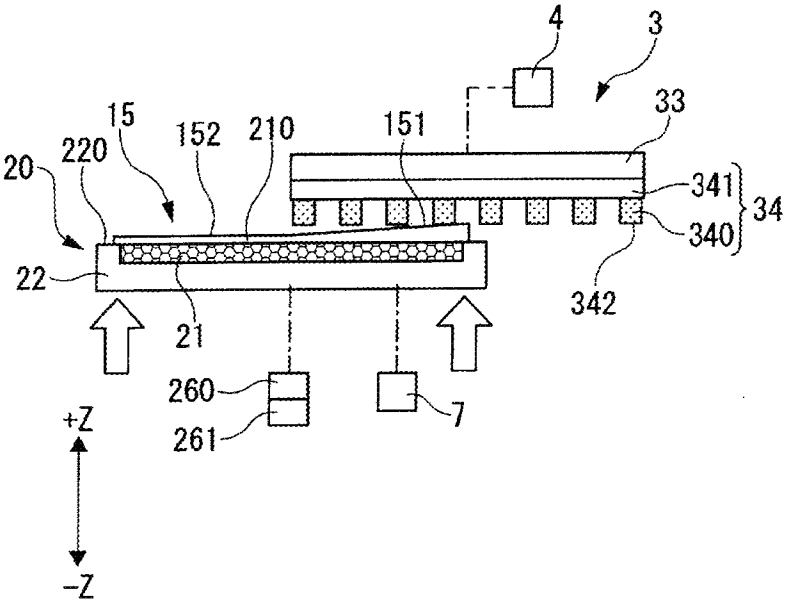
FIG. 7B is a sectional view depicting a manner of grinding a small fan-shaped part.
Figure 7A:
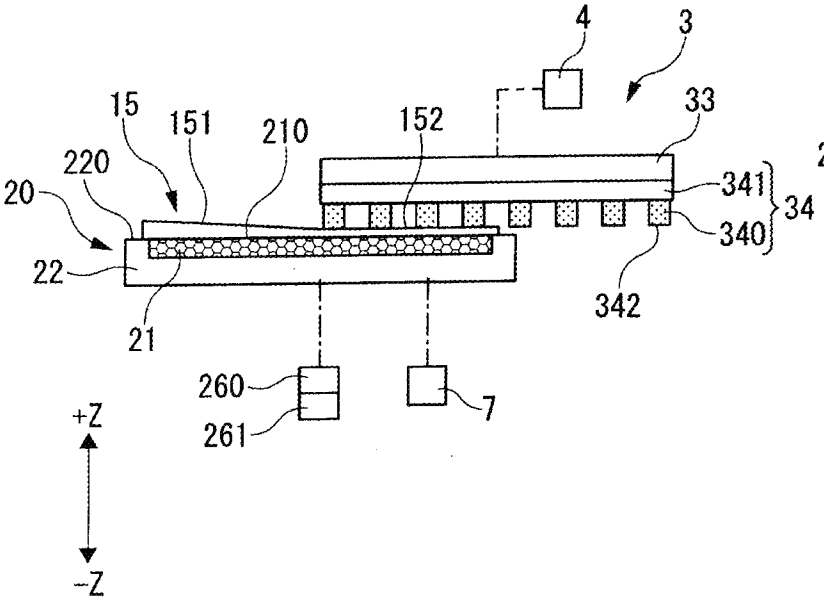
FIG. 7A is a sectional view depicting a manner of grinding a large fan-shaped part.

Then, the lower surfaces 342 of the grindstones 340 being rotated are brought into contact with the workpiece 15 held on the holding surface 210 as depicted in FIG. 7A. While the lower surfaces 342 of the grindstones 340 are in contact with the large fan-shaped part 152 of the workpiece 15 in the state depicted in FIG. 7A, since the chuck table 20 is being rotated by the motor 260, the lower surfaces 342 of the grindstones 340 come into contact with the small fan-shaped part 151 of the workpiece 15 soon, as depicted in FIG. 7B.

Here, under the control of the control unit 19, a voltage is supplied to the piezoelectric actuators 71 of the three fine adjustment devices 7, the piezoelectric actuators 71 supporting the chuck table 20, whereby the holding surface 210 is raised in the +Z direction. As a result, the height of the holding surface 210 is raised as compared to a state in which the lower surfaces 342 of the grindstones 340 are in contact with the large fan-shaped part 152 of the workpiece 15, so that the small fan-shaped part 151 of the workpiece 15 is ground much as compared to the state in which the lower surfaces 342 of the grindstones 340 are in contact with the large fan-shaped part 152.

When the chuck table 20 is further rotated and the lower surfaces 342 of the grindstones 340 again make contact with the large fan-shaped part 152 of the workpiece 15 as depicted in FIG. 7A, the voltage supplied to the three piezoelectric actuators 71 is reduced under control of the control unit 19, whereby the holding surface 210 is lowered to the original height position.

Thus, by controlling the voltage supplied to the piezoelectric actuators 71 according to the rotational angle of the chuck table 20 to thereby modify the height of the holding surface 210, when the lower surfaces 342 of the grindstones 340 are in contact with the small fan-shaped part 151, much grinding is conducted as compared to a state in which the lower surfaces 342 of the grindstones 340 are in contact with the large fan-shaped part 152, whereby the workpiece 15 can be corrected to a uniform thickness.

Note that the inclination of the holding surface 210 may be modified such that the small fan-shaped part 151 of the workpiece 15 is more largely ground, instead of raising the whole part of the holding surface 210 in the +Z direction by use of the fine adjustment devices 7 described above. Specifically, in a state in which the lower surfaces 342 of the grindstones 340 are in contact with the small fan-shaped part 151, that part of the holding surface 210 at which the small fan-shaped part 151 of the workpiece 15 is held may be raised in the +Z direction, by use of one or two of the three fine adjustment devices 7, whereby also the small fan-shaped part 151 of the workpiece 15 is ground much largely as compared to a state in which the lower surfaces 342 of the grindstones 340 are in contact with the large fan-shaped part 152, and the workpiece 15 can be corrected to a uniform thickness.

Figure 8:
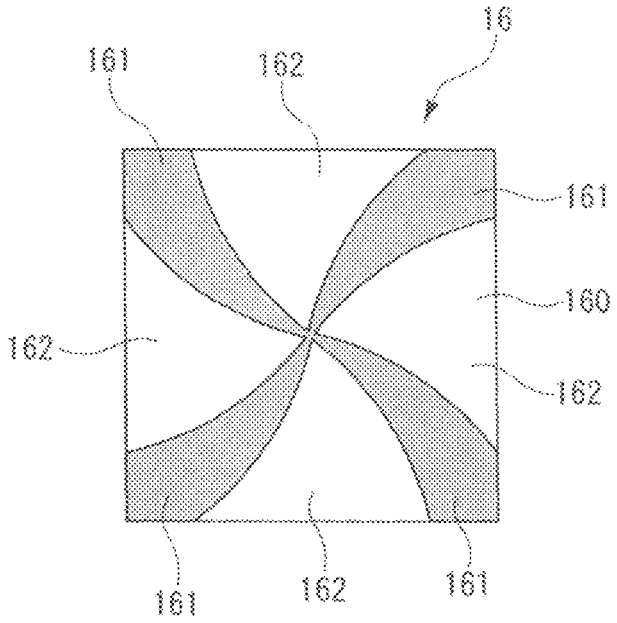
FIG. 8 is a top plan view depicting another example of the workpiece.

In addition, also in a workpiece 16 having a first part 161 and a second part 162 smaller in thickness than the first part 161 as depicted in FIG. 8, when the lower surfaces 342 of the grindstones 340 are brought into contact with an upper surface 160 of the workpiece 16, while detecting the rotational angle of the chuck table 20 by use of the encoder 261 and while adjusting the height of the holding surface 210 by use of the fine adjustment devices 7, it is thereby possible to grind the workpiece 16 to correct the workpiece 16 to a uniform thickness.

Note that, since the workpiece 16 depicted in FIG. 8 is tetragonal, a difference in thickness is generated according to the length of the track of the grindstones. Therefore, according to the size of the workpiece 16, voltages supplied to the fine adjustment devices 7 are preliminarily set according to the rotational angle. Note that the boundary between the first part 161 and the second part 162 are gradually varying in thickness. Therefore, at the boundary, the voltage is continuedly varied according to the rotational angle.

Since the fine adjustment device 7 has a high responsiveness due to the elastic structure composed of the plurality of slits 73 formed in the support member 70 depicted in FIG. 3, it is possible to modify the inclination of the holding surface 210 and to modify the height position of the holding surface 210 at a high speed as compared to existing adjustment shafts. In addition, due to its high responsiveness, the fine adjustment devices 7 can adjust extremely minutely the distance 6 between the table base 23 and the base 53. Further, since the fine adjustment devices 7 can be shortened in whole length as compared to the related art, a reduction in size of the processing apparatus 1 can be realized.

Note that, while the processing apparatus 1 has been described as the grinding apparatus in the above embodiment, the processing apparatus 1 in the present application is not limited to the grinding apparatus, and is applicable also to a polishing apparatus that polishes a wafer by rotating a polishing pad.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A fine adjustment device that is interposed between a table base rotatably supporting a chuck table for holding a workpiece on a holding surface and a base supporting the table base and that adjusts a distance between the table base and the base, the fine adjustment device comprising:

a support member that has an upper section and an intermediate section and a lower section, with the upper section fixed to the table base and with the intermediate section fixed to an upper surface of the base;

an accommodating chamber formed in the support member;

a piezoelectric actuator that is accommodated in the accommodating chamber and is capable of contracting and extending in a perpendicular direction relative to the upper surface of the base; and a contraction-extension structure in which first slits for cutting the intermediate section partially from a first side and second slits for cutting the intermediate section partially from a side opposite to the first side are alternately formed in plurality, whereby the accommodating chamber is capable of being contracted and extended in the perpendicular direction relative to the upper surface of the base, wherein, by controlling a voltage supplied to the piezoelectric actuator, the piezoelectric actuator is contracted and extended, and the contraction-extension structure is contracted and extended to enable the distance between the base and the table base to be changed.

2. The fine adjustment device according to claim 1, wherein a plurality of the fine adjustment devices are disposed between the table base and the base at intervals in a circumferential direction, and, by finely adjusting the plurality of fine adjustment devices, an inclination of the holding surface of the chuck table mounted on the table base is adjusted.

3. The fine adjustment device according to claim 1, further comprising:

a compression spring mechanism that compresses the contraction-extension structure.

4. A processing apparatus comprising:

a chuck table that holds a workpiece on a holding surface;

a processing unit that has a processing tool disposed in a rotatable manner and that processes the workpiece held on the holding surface of the chuck table;

a control unit; and a fine adjustment device that is interposed between a table base rotatably supporting the chuck table and a base on which the table base is disposed and that adjusts a distance between the table base and the base, wherein the fine adjustment device includes a support member that has an upper section and an intermediate section and a lower section, with the upper section fixed to the table base and with the intermediate section fixed to an upper surface of the base, an accommodating chamber formed in the support member, a piezoelectric actuator that is accommodated in the accommodating chamber and is capable of contracting and extending in a perpendicular direction relative to the upper surface of the base, and a contraction-extension structure in which first slits for cutting the intermediate section partially from a first side and second slits for cutting the intermediate section partially from a side opposite to the first side are alternately formed in plurality, whereby the accommodating chamber is capable of being contracted and extended in the perpendicular direction relative to the upper surface of the base, and the control unit controls a voltage supplied to the piezoelectric actuator of the fine adjustment device, to thereby contract and extend the piezoelectric actuator, whereby an inclination of the holding surface of the chuck table mounted on the table base in a rotatable manner is capable of being adjusted.

5. The processing apparatus according to claim 4, wherein the processing tool includes a rotatable grinding wheel on which a plurality of grindstones are arranged in an annular pattern, the processing apparatus further includes:

a motor that rotates a rotary shaft of the chuck table around about a center point of the holding surface; and an encoder that detects a rotational angle of the rotary shaft, and the control unit controls a voltage supplied to the piezoelectric actuator according to the rotational angle detected by the encoder, to thereby change the inclination of the holding surface of the chuck table according to the rotational angle and to grind the workpiece by the grindstones.

* * * * *